United States Patent [19]

Cogbill, II

[11] 4,258,728

[45] Mar. 31, 1981

[54] PROCESS FOR IMPROVING THE FILL POWER OF RECONSTITUTED TOBACCO

[75] Inventor: Philip H. Cogbill, II, Pineville, N.C.

[73] Assignee: Brown & Williamson Tobacco Corporation, Louisville, Ky.

[21] Appl. No.: 47,453

[22] Filed: Jun. 11, 1979

[51] Int. Cl.[3] ..... A24B 3/18

[52] U.S. Cl. ..... 131/137; 131/140 C

[58] Field of Search ..... 131/140, 140 C, 120, 131/137, 145; 241/236, 70

[56] References Cited

U.S. PATENT DOCUMENTS

| | | | |
|---|---|---|---|
| 3,077,890 | 2/1963 | Doyle et al. | 131/140 C |
| 4,000,748 | 1/1977 | Summers | 131/140 C |
| 4,186,755 | 2/1980 | Schmidt | 131/137 X |
| 4,195,646 | 4/1980 | Kite | 131/120 |

*Primary Examiner*—Stephen C. Pellegrino

*Attorney, Agent, or Firm*—Charles G. Lamb; William J. Mason

[57] ABSTRACT

A process for improving the fill power of reconstituted tobacco including the steps of wrinkling the tobacco and then shattering the wrinkled tobacco material. The wrinkling is accomplished by simultaneously steaming and tumbling the tobacco, and the shattering is accomplished by a selective milling of the wrinkled tobacco material.

7 Claims, 3 Drawing Figures

PROCESS FOR IMPROVING THE FILL POWER OF RECONSTITUTED TOBACCO

BACKGROUND OF THE INVENTION (1) Field of the Invention

This invention relates to a method for producing an improved reconstituted tobacco. More particularly, this invention relates to a process for improving the fill power of reconstituted tobacco. Even more particularly, the invention relates to a process of making a reconstituted tobacco having improved filling power by first wrinkling the reconstituted tobacco and then shattering the wrinkled reconstituted tobacco under selective milling conditions.

(2) Description of the Prior Art

In the manufacture of tobacco products, particularly cigarettes, a considerable amount of tobacco scraps are produced. In view of the high cost of the tobacco, it has been found desirable to reprocess this scrap material into a useable condition commonly known as "reconstituted tobacco". In the process for conditioning this scrap tobacco into reconstituted or reuseable form, the scrap material is generally slurried or chemically treated by different means to form sheets wherein the sheet material is then further processed to lower the bulk density by crimping, wrinkling, or the like and then cutting, the end product to resemble naturally cut tobacco. The material that has been reprocessed and cut to selected specification is then useable along with, or alternatively as, a substitute for natural tobacco in cigarette products.

In the processing of the reconstituted tobacco sheets, many different methods and apparatuses have been devised in which material is processed to give a bulk density equivalent to cut "natural" tobacco. For example, U.S. Pat. No. 3,430,634; U.S. Pat. No. 3,431,915; and, U.S. Pat. No. 3,477,440 describe different methods and apparatuses wherein textured rollers are utilized for wrinkling reconstituted tobacco sheets. U.S. Pat. No. 1,647,694 teaches a method and apparatus for crimping strips of reconstituted tobacco with a special cutting edge. U.S. Pat. No. 4,000,748 relates to an apparatus and process for shreading and crimping smoking materials using a pair of rotating and intermeshing stacks of discs. And, U.S. Pat. No. 4,074,722 teaches a process for manufacturing smokable tobacco products through selective handling of strip tobacco based on particle size and shape. However, none of these patents teach a process or method for wrinkling reconstituted tobacco and then shattering the wrinkled product wherein the fill power is relatively high and the amount of fines produced during the process is relatively low.

SUMMARY OF THE INVENTION

It is an object of the present invention to provide a method for wrinkling a reconstituted tobacco material sheet and then shattering the sheet to improve the fill power in a cigarette product. It is another object of this invention to provide a process for the conditioning of reconstituted tobacco sheets wherein the end product has a relatively high fill power and the process is substantially efficient in that a relatively low percentage of fines or dust is produced. Other objects and advantages of this invention will become apparent to those skilled in the art upon consideration of the accompanying disclosure.

The present invention resides in the recognition that by wrinkling reconstituted tobacco prior to shattering and then shattering the wrinkled product under selective milling conditions, the fill power of the reconstituted tobacco is increased and the amount of fines produced in the process is relatively low. It has been found tht the wrinkling may best be carried out under controlled steaming conditions in a rotating cylinder wherein the steam and the tumbling action of the cylinder both wrinkles and decreases the bulk density of the product. In the shattering of the wrinkled material, it has been found that preferred shattering devices include attrition mills or hammermills operated under preselected operating conditions. As used in the invention, a preferred attrition mill includes a pair of spaced discs, one of the discs being rotatable and the other being stationary with the spacing between the discs being critical. Also, hammermills operated under selected conditions will provide a shattering mechanism which delivers a product which has a low bulk density and a relatively small percentage of fines or dust material is produced.

According to the present invention, one preferred process for improving the fill power of reconstituted tobacco comprises the steps of: steaming and tumbling, simultaneously, reconstituted tobacco, and shattering the steamed and tumbled tobacco. Preferably, the steaming and tumbling include feeding the reconstituted tobacco into a rotating cylinder having steam injection means therein wherein the product discharging from the cylinder has a moisture content of from 12 to 25 percent by weight and the temperature of the exiting tobacco is from about 90° F. to 160° F. The shattering of the tobacco includes either milling in a disc mill (attrition mill) wherein the disc mill includes a pair of spaced discs, one rotatable and the other stationary, or by hammermilling. More preferably, in a selected tobacco product for use as a cigarette filler when using an attrition mill, the spaced discs are from about 12 to 48 inches in diameter with a speed of approximately from about 800 to 1300 revolutions per minute with the gap between the discs being from 0.050 to 0.100 inches. As for a preferred hammermill, the hammers are from about ¼ to ½ inches wide with about ½ to 1½ inches being between the parallel hammers with the screen basket on the discharge being from 5/16 to ¾ inches. The hammermill generally rotates at from 650 to 1400 revolutions per minute.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
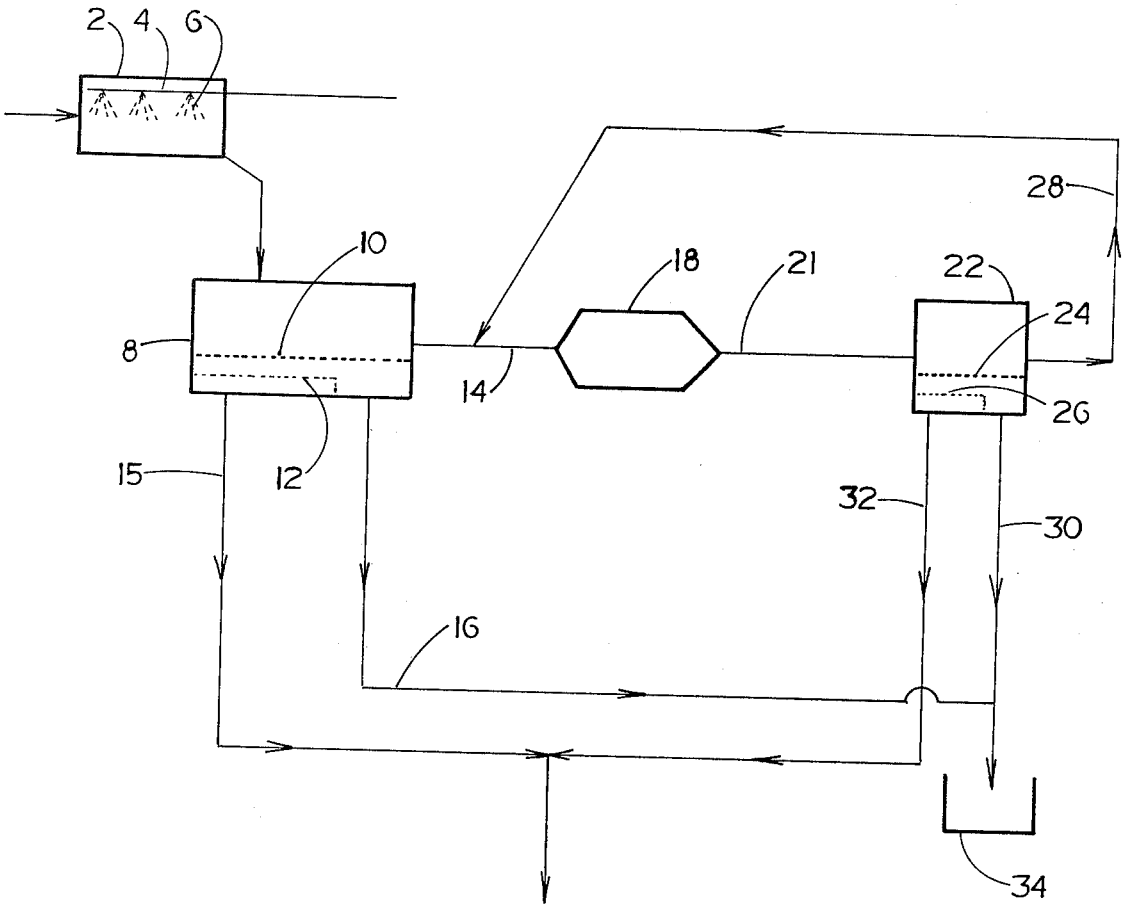
FIG. 1 is a schematic flow diagram illustrating an apparatus and process for manufacturing smokable tobacco products in accordance with the present invention.

In FIG. 1, a sheet of reconstituted tobacco is fed through a rotating cylinder 2 wherein the reconstituted tobacco sheet is tumbled and steamed. Steam is added through a conduit 4 from a steam supply source (not shown), steam conduit 4 being provided with a plurality of nozzles 6 spaced at predetermined locations so as the tobacco sheets tumble, they are subjected to the incoming steam. In a preferred steaming and tumbling condition, the steam is introduced so the discharge product is from about 12 to 25 percent moisture and at a temperature of from 90° to 160° F.

The material from the rotating cylinder produces a wrinkled product which is then fed to a double-screen device 8, which includes a quarter-inch screen 10 and a 20-mesh screen 12 therein. The overs from the quarter-inch screen are removed to a milling device through line 14, to be discussed hereinafter, wherein the material caught on the 20-mesh screen, which is between minus quarter-inch and plus 20-mesh, is removed through line or conduit 16 for further processing as feed material for a cigarette product. All of the material which passes through the 20-mesh screen is then removed through line 15 as dust for further processing (not shown), which is generally recovering means for use as feed for another sheet of reconstituted tobacco.

The overs, which are plus quarter-inch material, are then fed through conduit 14 to a mill 18, which may be either an attrition mill (FIG. 3) or a hammermill (FIG. 2), which may be any known in the art, wherein the plus quarter-inch material from line 14 is shattered with the material being removed through line 21. The material leaving the milling device 18 through line 21 is then passed through another double screening device 22, which includes a quarter-inch screen 24 and a 20-mesh screen 26 therein. The overs from the quarter-inch screen are then refed by any well known means through line 28 back to the milling device 18 for reshattering. The material that is caught on the 20-mesh screen, which is less than quarter-inch and greater than 20-mesh, is then removed through line 30 for further blending and processing as cigarette or tobacco filler. The material that passes through screen 26 is less than 20-mesh and is removed through line 32 as dust for further processing.

Figure 2:
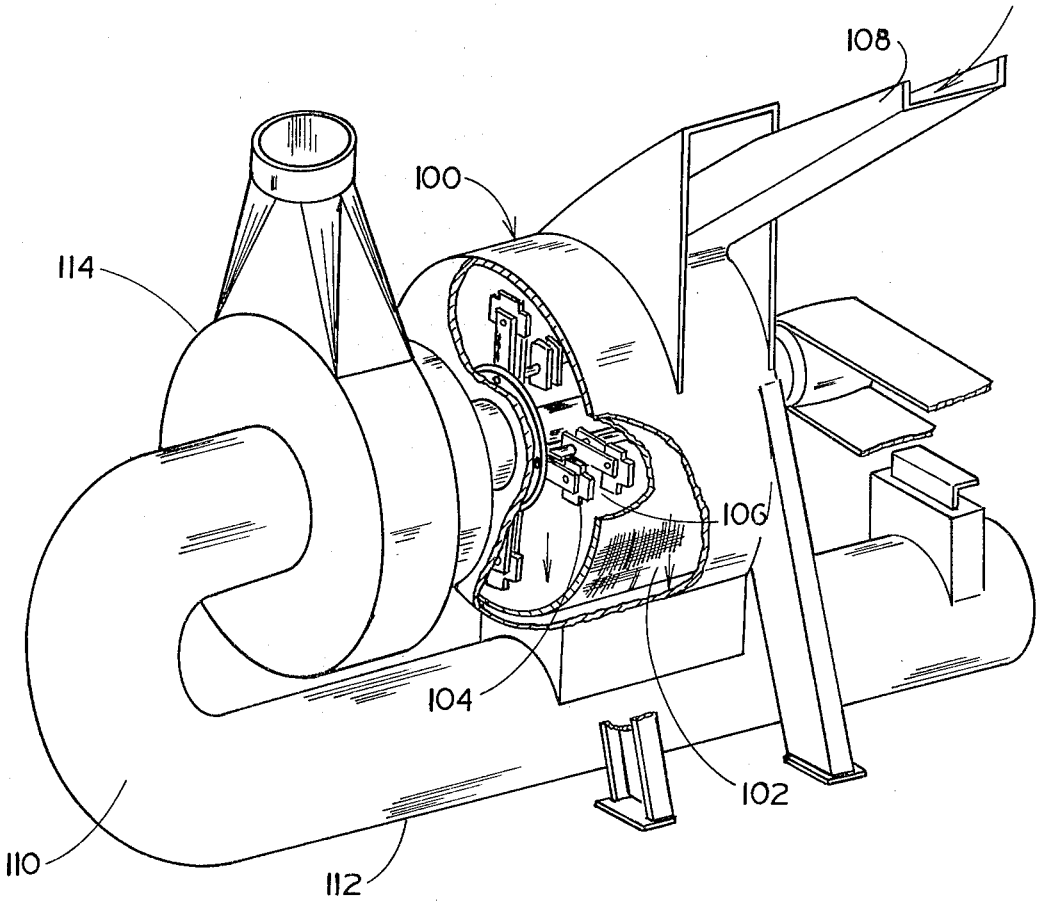
FIG. 2 is a perspective view, with selected portions cut-away, of one preferred hammermill which may be used in the present invention; and, FIG. 3 is a perspective view, with selected portions cut-away, of one preferred disc mill which may be used in the present invention.

In FIG. 2 is shwon a typical hammermill 100 which may be utilized in the present invention. As discussed hreinbefore, the hammermill may be any presently available in the prior art, but the discharge screen 102 must be provided with openings from between 5/16 and ¾ inch; the hammers 104 are from ¼ to ½ inch in width with about ½ to 1½ inch spacings therebetween, as noted by the numeral 106; and, the hammers rotate at from 650 to 1400 revolutions per minute. Operating outside the aforementioned ranges results in the the production of either a high dust content or an appreciably large amount of material to be re-run through the mill.

The hammermill 100 is further provided with a feed chute 108 for feeding tobacco to the mill and an air-veying system 110 for removing the milled tobacco therefrom. The air-veying system 110 is provided with an air duct 112 and a blower 114, which are shown enclosed.

Figure 3:
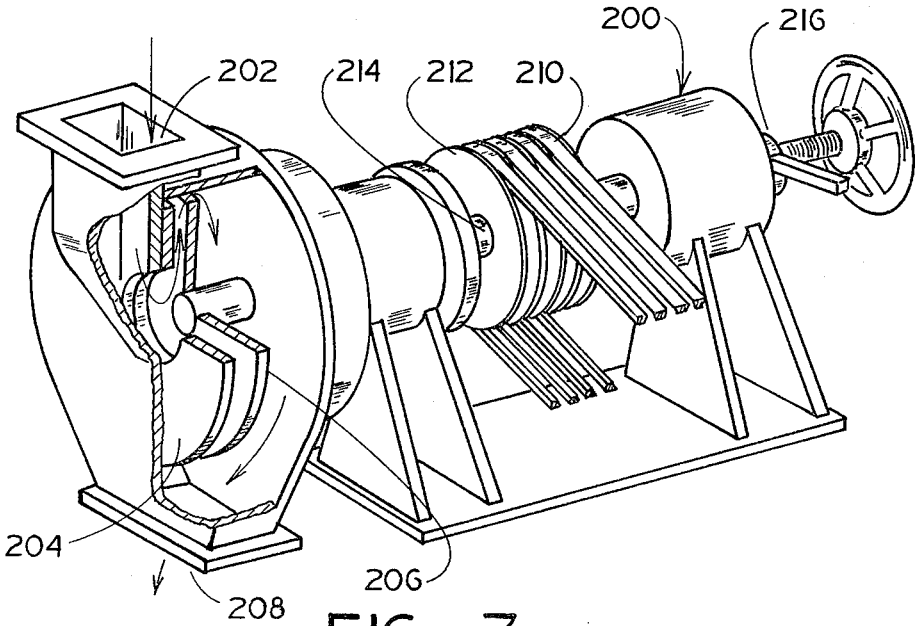

In FIG. 3 is shown a typical disc or attrition mill 200 which may be utilized in the present invention. As discussed hereinbefore, the disc mill may be any presently available in the prior art. However, it is realized that the spacings between the discs and the rotatable speed of the rotatable disc is critical. In FIG. 3, material to be milled is fed into mill 200 through feed inlet 202 and passes between the stationary disc 204 and the rotatable disc 206. The discs 204 and 206 are from about 12 to 48 inches in diameter and the rotatable disc 206 rotates at a speed of from about 800 to 1300 r.p.m. It has been found that in this range, in order to obtain an acceptable product, the spacing between the discs should be from about 0.050 to 0.100 inches.

The milled tobacco is then discharged through outlet 208.

The mill 200 is driven by any known means, but is shown as being pulley driven by pulleys 210 and sheaves 212, the driving means not being shown. Sheaves 212 are mounted onto a shaft 214 at one end and at the other end of the shaft is mounted the rotatable disc 206. Adjusting means as represented by the numeral 216 may be any known in the art for adjusting the pulleys and sheaves and is therefore not discussed in detail herein.

A more comprehensive understanding of the invention can be obtained by considering the following specific examples. However, it should be understood that the examples are not intended to be unduly limitative of the invention.

EXAMPLES I–III

The following examples demonstrate the procedure that was followed in steaming and tumbling reconstituted tobacco sheets at various moisture levels and then shattering the sheets in an attrition mill.

In a rotary mounted cylinder having an inside diameter of 28 inches and a length of 44 inches with 6 flights therein, each flight being 4 inches wide and equally spaced along the entire length of the cylinder, a batch of reconstituted tobacco sheets was fed. The cylinder rotated at approximately 13 revolutions per minute, 0° inclination. Retention time of the tobacco in the unit was from about 2 to 4 minutes for each batch run through the unit. Steam was added to the cylinder at a rate so that the moisture content of the runs was between 15 and 20 percent by weight of total product at a temperature of 100° to 150° F. The resulting product was then ready for feed to a screening device having a quarter-inch screen and a 20-mesh screen disposed therein.

The steamed and tumbled tobacco was then fed through a double screening device having a quarter-inch and a 20-mesh screen therein wherein the plus quarter-inch material was then fed to an attrition mill, the material caught on the 20-mesh screen was recovered as product, and the material passing through the 20-mesh screen was caught as dust for reprocessing. Table 1 below shows the distribution of material through the screening device for different moisture levels of reconstituted tobacco that was processed.

The overs, or the plus quarter-inch material from the screening device, were fed to an attrition mill having a pair of 13 inch diameter discs therein spaced with a 0.072 inch gap therebetween. One of the discs was stationary and the other rotated at 1000 revolutions per minute. The product from the attrition mill was then fed to another double screen device which included a quarter-inch screen and a 20-mesh screen therein and the distribution of the material from the double-screen is shown in Table 1 for the different concentrations of moisture.

TABLE 1

| Example | % Moisture Before Grinding | Screening +¼" | Screening −¼ + 20-Mesh | Screening −20-Mesh | Attrition Mill Fill Value mg/cc | Attrition Mill % + 6-Mesh In Product | Attrition Mill % Dust (−20-Mesh) |
|---|---|---|---|---|---|---|---|
| I | 10.2 (no steam) | 20.4 | 73.7 | 5.9 | 260 | 64 | 5.9 |
| II | 15.1 | 41.6 | 54.6 | 3.8 | 220 | 81 | 3.8 |
| III | 18.8 | 53.4 | 42.5 | 4.1 | 217 | 74 | 4.1 |

From the above data it can be seen that steaming gives an increase in the percentage of plus 6-mesh material in the product and reduces the amount of dust. Furthermore, the fill value for the steamed material is also higher than that for the non-steamed material and it is believed that this is attributable to a very large percentage of +6-mesh material being in the product.

EXAMPLES IV–VII

The following examples demonstrate the procedure that was followed in the screening and milling of steamed and tumbled reconstituted tobacco in a hammermill.

Steamed and tumbled tobacco, as described in Examples I–III, was fed through a double screening device having a quarter-inch and a 20-mesh screen therein, the quarter-inch screen being disposed above the 20-mesh screen, wherein the plus quarter-inch material was then fed to a hammermill, the material caught on the 20-mesh screen being recovered as product, and the material passing through the 20-mesh screen being caught as dust for reprocessing.

The overs, or the plus quarter-inch material from the screening device, were fed to a hammermill having ¼" hammers therein with ½" spacing between the hammers. Screen sizes and hammer rotational speeds were varied for different moisture levels in the tobacco. The product from the hammermill was then fed to another double-screen device which included a ¼" screen and a 20-mesh screen therein and the distribution of the material from the double-screen is shown in Table 2 for the different concentrations of moisture.

TABLE 2

| Ex. | % Moisture Before Grinding | Rotational Speed, RPM | Screen Size Opening | Fill Value mg/cc | % + 6-Mesh In Product | % Dust (−20-Mesh) |
|---|---|---|---|---|---|---|
| IV | 23.0 | 1320 | ¾" | 174 | 45.25 | 1.9 |
| V | 22.3 | 1320 | 7/16" | 186 | 45.75 | 2.8 |
| VI | 21.2 | 1020 | 5/16" | 220 | 51.79 | 4.0 |
| VII | 21.4 | 1500 | 7/16" | 192 | 47.35 | 3.2 |

From the above data it can be seen that an acceptable product can be obtained by milling steamed and tumbled reconstituted tobacco in a hammermill.

What is claimed is:

1. A process for improving the fill power of reconstituted tobacco comprising the steps of:

wrinkling reconstituted tobacco; and, shattering the wrinkled tobacco with a hammer mill wherein said hammer milling is performed at from 650 to 1400 revolutions per minute with a discharge screening through from 5/16 to ¾ inch screen.

2. The process of claim 1, said wrinkling including simultaneous steaming and tumbling.

3. The process of claim 2 wherein said steaming and tumbling includes feeding said reconstituted tobacco to a rotating cylinder having steam injection means therein.

4. The process of claim 3, said reconstituted tobacco exiting from said rotating cylinder being at from about 12 to 25 percent by weight moisture at a temperature of from about 90° to 160° F.

5. A system for improving the fill power of reconstituted tobacco comprising: means for wrinkling reconstituted tobacco, means to feed the wrinkled tobacco to a hammermill; the hammermill having a plurality of hammers therein of from about ¼ to ½ inch in width with a spacing between said hammers of from about ½ to 1½ inches, said hammers being rotatable at from 650 to 1400 revolutions per minute, said hammermill having a feed means at its inlet and a discharge screen at its outlet, said discharge screen having openings therein of from 5/16 to ¾ inch; and, air-veying means in flow communication with the outlet of said hammermill and to tobacco separating means, said tobacco separating means including means to segregate the tobacco into different particle size ranges.

6. The system of claim 5, said means for wrinkling including a rotatable cylinder having steam injection means therein.

7. The system of claim 5, said tobacco separating means including a double-screen, said double-screen including a ¼ inch screen and less than a 16-mesh screen, said ¼ inch screen being disposed above said less than a 16-mesh screen.

* * * * *